US008136269B1

(12) United States Patent
Sempf

(10) Patent No.: US 8,136,269 B1
(45) Date of Patent: Mar. 20, 2012

(54) BACKBLADE-AND-SNOWPLOW SYSTEM

(76) Inventor: William Vincent Sempf, Hastings, MI (US)

( * ) Notice: Subject to any disclaimer, the term of this patent is extended or adjusted under 35 U.S.C. 154(b) by 0 days.

(21) Appl. No.: 12/321,628

(22) Filed: Jan. 23, 2009

Related U.S. Application Data

(62) Division of application No. 11/138,507, filed on May 26, 2005, now abandoned.

(51) Int. Cl.
*E01H 5/06* (2006.01)

(52) U.S. Cl. ..... 37/266; 172/811

(58) Field of Classification Search ..... 37/231, 37/232, 233, 266, 268, 270; 16/DIG. 40; 172/136, 811
See application file for complete search history.

(56) References Cited

U.S. PATENT DOCUMENTS

| | | | | |
|---|---|---|---|---|
| 2,899,760 | A | 8/1959 | Armington et al. | |
| 2,936,537 | A | 5/1960 | Bain | |
| 3,465,456 | A * | 9/1969 | Meyer | 37/233 |
| 3,775,877 | A | 12/1973 | Gove, Sr. | |
| 4,261,115 | A * | 4/1981 | Chittenden | 37/268 |
| 4,709,492 | A | 12/1987 | Watson | |
| 5,140,763 | A | 8/1992 | Nichols, IV | |
| 5,611,157 | A | 3/1997 | Ferreira | |
| 5,715,613 | A | 2/1998 | Ebert | |
| 5,775,012 | A | 7/1998 | Hockensmith | |
| 5,819,443 | A | 10/1998 | Winter | |
| 6,256,910 | B1 | 7/2001 | Grozde | |
| 6,701,646 | B2 | 3/2004 | Schultz et al. | |
| 2004/0006895 | A1 | 1/2004 | Schultz et al. | |

* cited by examiner

*Primary Examiner* — Robert Pezzuto
*Assistant Examiner* — Jamie L McGowan
(74) *Attorney, Agent, or Firm* — Bliss McGlynn, P.C.

(57) ABSTRACT

A bottom of a snowplow defines a front, plowing surface and an inverted shelf disposed directly behind the plowing surface, and the shelf defines a first side abutting against a rear of the plowing surface and a second side of the shelf extending away from the rear of the plowing surface. A backblade-and-snowplow system comprises a bent, rigid blade defining a top and back and at least one hole in the top of the blade corresponding to a hole defined in the second side of the shelf. At least one fastening mechanism is passed through the corresponding hole defined in the second side of the shelf and the hole defined in the top of the blade to secure the blade to the shelf. At least one L-shaped bracket defines a top edge secured along the top and back of the blade and a first side of the bracket positioned flush with the first side of the shelf. The first side of the bracket further defines at least one hole suitable for receipt of a corresponding fastening device that passes through the first side of the shelf and the hole of the first side of the bracket to secure the blade to the shelf such that a substantial entirety of the blade is disposed directly behind the plowing surface of the snowplow.

1 Claim, 5 Drawing Sheets

BACKBLADE-AND-SNOWPLOW SYSTEM

CROSS REFERENCE TO RELATED APPLICATIONS

This application is a Divisional Application of application Ser. No. 11/138,507 filed on May 26, 2005 now abandoned.

FEDERALLY SPONSORED RESEARCH

Not Applicable

SEQUENCE LISTING OR PROGRAM

Not Applicable

BACKGROUND OF THE INVENTION

1. Field of the Invention

This invention relates generally to a method for the attachment of a snowplow back blade and apparatus for the movement or removal of snow, earth, or other materials by means of a plow, and more specifically to a method for the attachment of a back blade, and corresponding apparatus, to a conventional snowplow blade to enhance the movement or removal of snow, earth, or other materials in both the forward and rearward directions as well as enhancing stability of the blade when operated in the forward or rearward directions.

2. Description of the Related Art

Methods of attachment and apparatuses for the movement or removal of materials such as snow, earth, or other materials, specifically when a snowplow is operated in the rearward direction, are known. The prior art discloses many such apparatuses related to the effective movement or removal of snow or other materials through unique design features and attachment mechanisms. Such apparatuses frequently consist of a blade or frame attached to the back or bottom of a conventional snowplow. The means of attachment and stability of such apparatuses, however, leave such apparatuses or their attachment mechanisms susceptible to damage, or introduce an undesirable situation where the snowplow is pushed downward or roll under due to a lack of stability.

U.S. Pat. No. 3,775,877 (Gove), discloses an entire snowplow assembly with reciprocating hydraulic motor and means for attaching same to a vehicle. This invention incorporates a means of positioning the assembly for operation in either the forward or rearward direction. Said means includes extending a motor to position the blade from its forwardly inclined plowing position, to a rearwardly inclined position. The device allows for the snowplow itself to be oriented slightly forward to expose a back plowing means that can override obstacles by employing safety-release springs.

U.S. Pat. No. 4,709,492 (Watson), discloses a back blade attachment that is attached directly to the "shoes" located on the back of a snowplow by means of a hinge, allowing the back blade attachment to pivot as the back blade encounters objects on the surface being plowed when operated in a rearward direction.

U.S. Pat. No. 5,140,763 (Nichols, IV), discloses a device attachable to the back of a snowplow, consisting of a frame to which a plurality of "fingers" extend below the snowplow edge, thereby allowing said "fingers" to remove snow from uneven surfaces that the snowplow is unable to reach. Further, U.S. Pat. No. 5,819,443 (Winter), also discloses an apparatus which attaches to the back of a snowplow, and also employs a series of "fingers" which adjust to uneven surfaces to facility the removal of snow or ice.

U.S. Pat. No. 5,715,613 (Ebert), discloses a blade which can be removeably attached to the bottom of a snowplow, creating both a forward and a rearward plowing blade. The forward and rearward plowing surfaces are attached to each other by a plurality of "reinforcing ribs," and the entire device may be attached to the bottom of a snowplow by means of a plurality of nut and bolt assemblages.

Thus, there remains a need in the art for a method for the easy attached of a back blade to the back and bottom of a snowplow, that facilitates plowing in the rearward direction, that enhances stability when the snowplow is operated in both the forward and rearward directions, and includes no moving parts that are susceptible to damage when exposed to snow or when placed under the strain of moving snow, earth, or other materials.

BRIEF SUMMARY OF THE INVENTION

Accordingly, the present invention overcomes the disadvantages in the relevant art in a backblade-and-snowplow system. A bottom of a snowplow defines a front, plowing surface and an inverted shelf disposed directly behind the plowing surface, and the shelf defines a first side abutting against a rear of the plowing surface and a second side of the shelf extending away from the rear of the plowing surface. The system comprises a bent rigid blade defining a top and back and at least one hole in the top of the blade corresponding to a hole defined in the second side of the shelf. At least one fastening mechanism is passed through the corresponding hole defined in the second side of the shelf and the hole defined in the top of the blade to secure the blade to the shelf. At least one L-shaped bracket defines a top edge secured along the top and back of the blade and a first side of the bracket positioned flush with the first side of the shelf. The first side of the bracket further defines at least one hole suitable for receipt of a corresponding fastening device that passes through the first side of the shelf and the hole of the first side of the bracket to secure the blade to the shelf such that a substantial entirety of the blade is disposed directly behind the plowing surface of the snowplow.

An advantage of the method and corresponding apparatus of the present invention is that it affords easy installation of a back blade to a conventional snowplow.

Another advantage of the method and corresponding apparatus of the present invention is that it utilizes no moving parts.

Another advantage of the method and corresponding apparatus of the present invention is that it utilizes existing features of the snowplow, thereby enhancing strength and stability when the snowplow is operated in either the forward or rearward directions.

Other objects and advantages of the present invention will become apparent from the following descriptions, taken in connection with the accompanying drawings, wherein, by way of illustration and example, an embodiment of the present invention is disclosed.

DETAILED DESCRIPTION OF THE PREFERRED EMBODIMENTS

Figure 1:
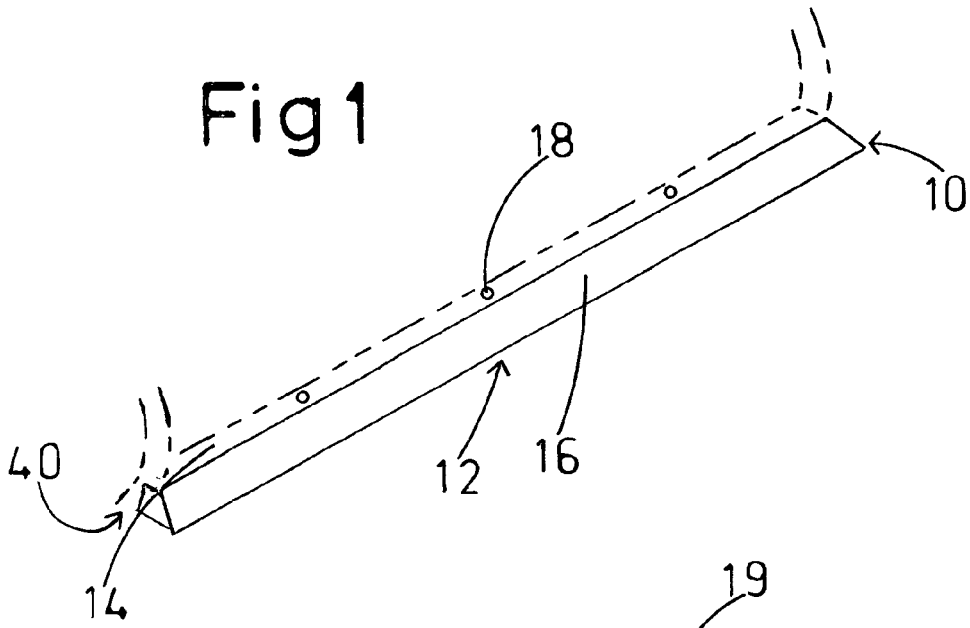
FIG. 1 is a perspective view of a back blade securely attached to a conventional snowplow utilizing the method of the present invention.

Referring now to the figures, a back blade of the present invention is generally indicated at 10. The back blade 10 is shown, per se, in FIGS. 1, 2, 4, and 5. In FIG. 1, the back blade 10 is shown as affixed to the back and bottom of a snowplow by utilizing the method of the present invention.

FIG. 1 illustrates that the back blade 10 of the present invention includes a bent rigid blade, generally indicated at 12, essentially coextensive in length to that of a snowplow. Said bent rigid blade 12 is bent at an angle substantially equal to 45 degrees, and includes a blade top 14 and a blade back 16, which may be beveled at the bottom. Said blade top 14 includes a plurality of holes 18, each suitable for receipt of a fastening mechanism. FIG. 1 further illustrates one of a plurality of L-shaped brackets, generally indicated at 40, used to affix said bent rigid blade 12 to the snowplow. Said L-shaped brackets 40 will be further illustrated in subsequent drawings.

It will be apparent to those having ordinary skill in the art that it is possible to bend said bent rigid blade 12 to any suitable degree. It will be further apparent to those having ordinary skill in the art that any suitable bracket may be used for attaching said bent rigid blade 12 to a snowplow.

Figure 2:
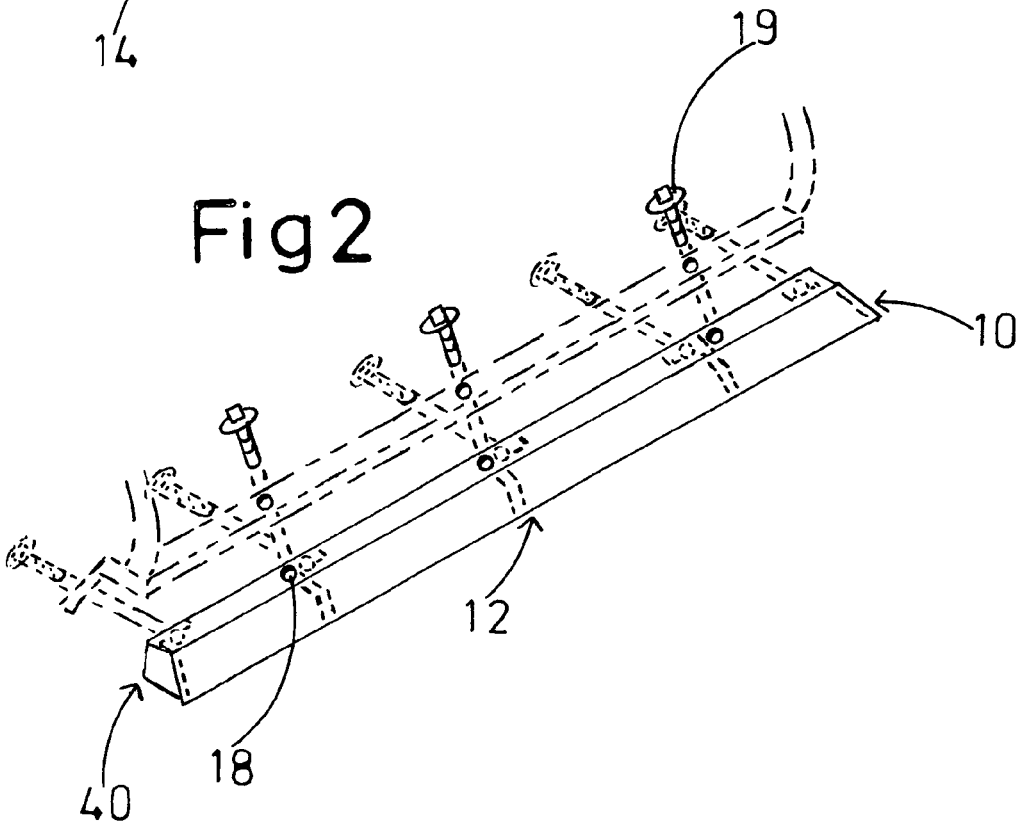
FIG. 2 is an explosion perspective view demonstrating the method of the present invention of attaching a back blade to the back and bottom of a snowplow.

In FIG. 2, a method for attaching said bent rigid blade 12 to said snowplow is illustrated, utilizing said plurality of L-shaped brackets 40 to affix said bent rigid blade 12 to the back of a snowplow. Further, FIG. 2 illustrates a method of attaching said bent rigid blade 12 to the bottom of a snowplow utilizing said plurality of holes 18 suitable for receipt of a fastening mechanism 19 such as a nut and bolt assemblage in said blade top 14 of said bent rigid blade 12.

Figure 3A:
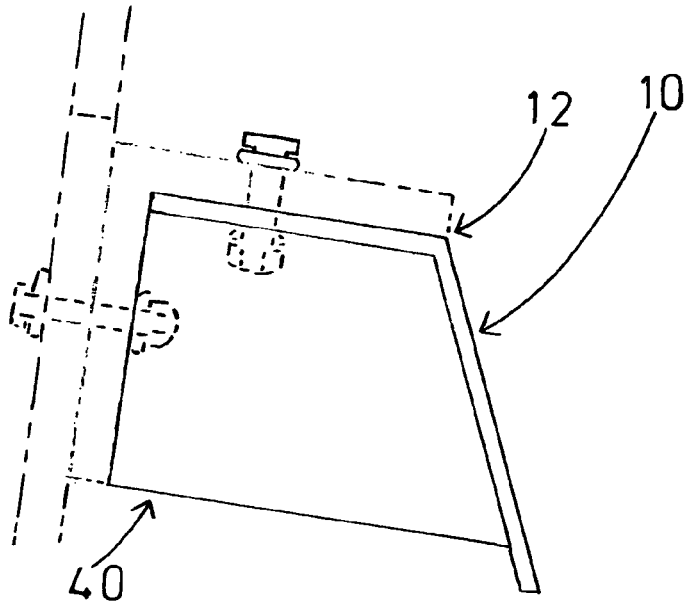
FIG. 3*a* is a side view of a snowplow, illustrating the means of affixing a back blade to the back and bottom of a snowplow utilizing the method of the present invention.
Figure 3B:
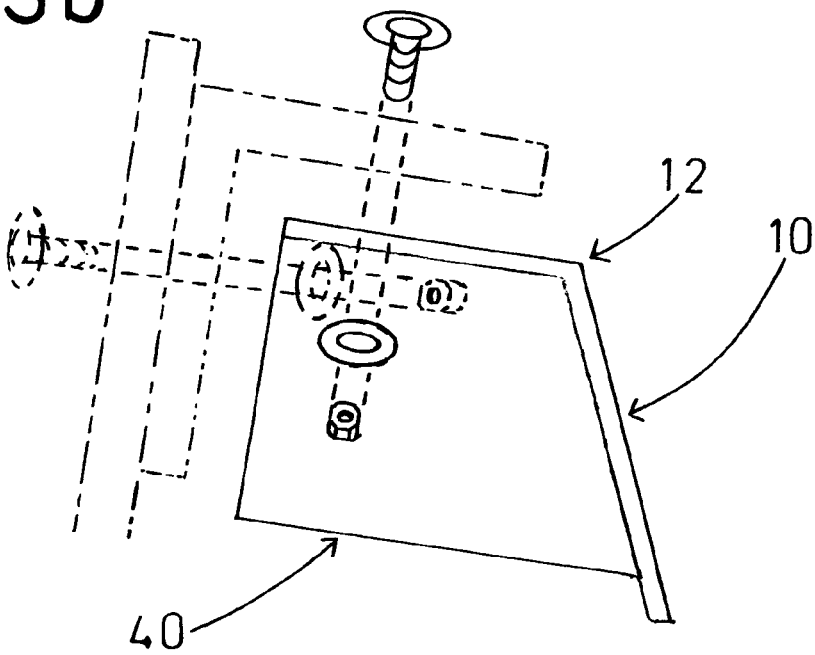
FIG. 3*b* is a side view explosion illustration of the method of attaching a back blade to the back and bottom of a snowplow.

FIG. 3*a* illustrates said back blade 10 in an attached position to the back and bottom of a snowplow. FIG. 3*b* illustrates the method in which said bent rigid blade 12 of said back blade 10 may be attached to the back and bottom of a snowplow. These figures illustrate one of said plurality of L-shaped brackets 40 affixed to said bent rigid blade 12, and the use of said plurality of fastening mechanisms 19 to attach said bent rigid blade 12 to both the back and bottom of a snowplow.

It will be apparent to those having ordinary skill in the art that it is possible to affix said bent rigid blade 12 to a snowplow by any suitable means and that said fastening mechanism 19 may be any suitable means for fastening.

Figure 4:
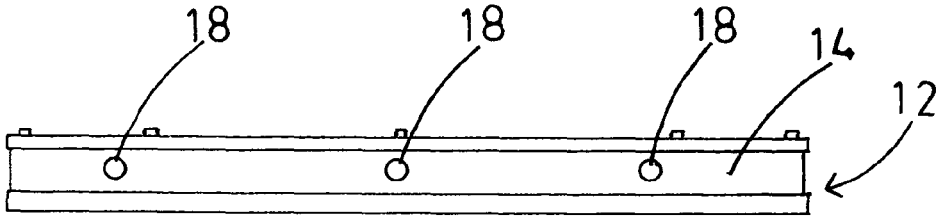
FIG. 4 is a top view of the back blade of the present invention.

FIG. 4 illustrates said blade top 14 of said bent rigid blade 12. This figure illustrates said plurality of holes 18 in said blade top 14. In this embodiment there are 3 such holes 18. However, it will be apparent to those having ordinary skill in the art that it is possible to have any number of a plurality of holes 18.

Figure 5:
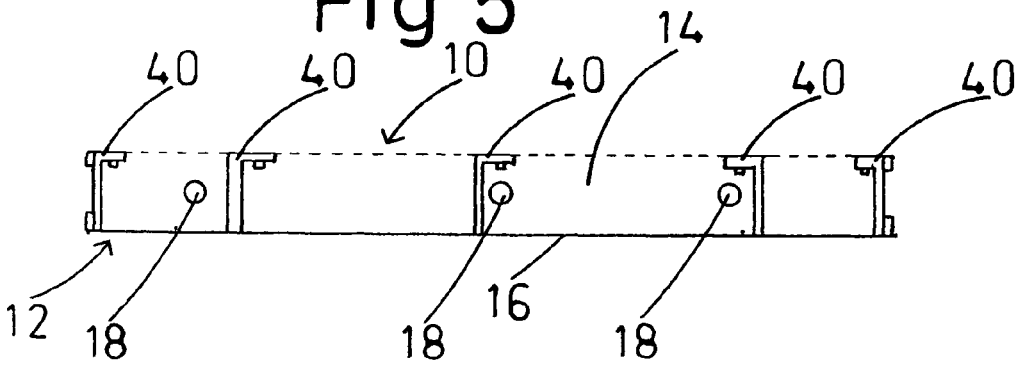
FIG. 5 is a bottom view of the back blade of the present invention.

FIG. 5 illustrates a view of the bottom of said back blade 10 and the manner in which said plurality of said L-shaped brackets 40 are employed to affix to said bent rigid blade 12 to a snowplow. Said plurality of L-shaped brackets 40 are welded to the blade top 14 and blade back 16. FIG. 5 further illustrates said plurality of holes 18 included in the blade top 14.

It will be apparent to those having ordinary skill in the art that it is possible to affix said L-shaped brackets 40 to said bent rigid blade 12 by any suitable means.

Figure 6A:
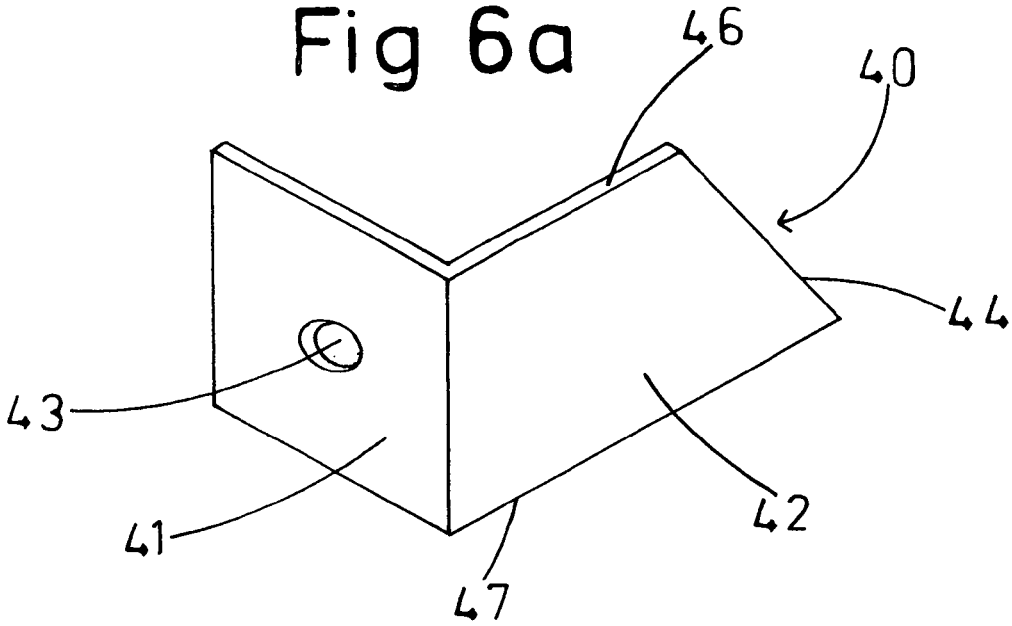
FIG. 6*a* is a plan view of the outside of an L-shaped bracket used for affixing a bent rigid blade to the back of a snowplow by utilizing the method of the present invention.

FIG. 6*a* illustrates the outside of one of said plurality of L-shaped brackets, 40. Said L-shaped bracket 40 having a first side 41 and a second side 42, with said first side 41 including a hole 43 for receipt of a fastening mechanism, and said second side including a beveled back 44. Further, said L-shaped bracket 40 includes a top edge 46 and a bottom edge 47, with said edges extending the length of said L-shaped bracket 40.

It will be apparent to those having ordinary skill in the art that it is possible that said beveled back 44 be cut at any suitable angle to fit into the bend in said bent rigid blade 12.

Figure 6B:
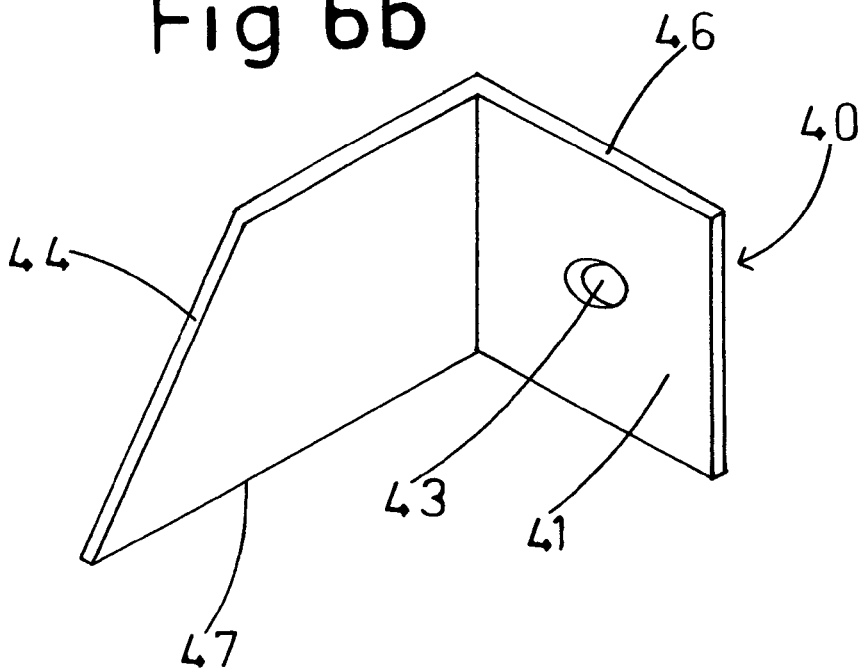
FIG. 6*b* is a plan view of the inside of an L-shaped bracket used for affixing the bent rigid blade of the present invention to the back of a snowplow by utilizing the method of the present invention.

FIG. 6*b* illustrates the inside view of said L-shaped bracket 40, again illustrating said top edge 46 and said bottom edge 47, said first side 41 and said second side 42, with said first side 41 including a hole 43 suitable for receipt of a fastening mechanism, and said second side including a beveled back 44.

Figure 7A:
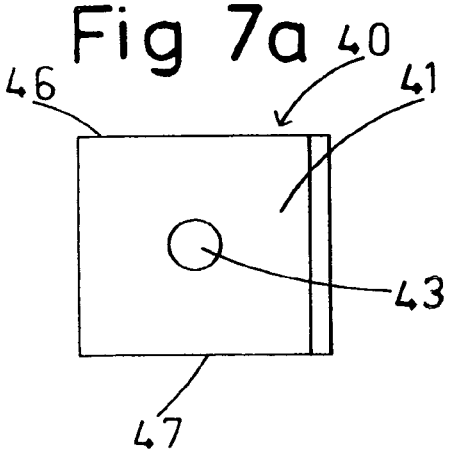
FIG. 7*a* is a side view of a first side an L-shaped bracket used for affixing the bent rigid blade of the present invention to the back of a snowplow by utilizing the method of the present invention.

FIG. 7*a* illustrates said first side 41 of one of said plurality of L-shaped bracket 40, including said hole 43 suitable for receipt of a fastening mechanism, said top edge 46 and said bottom edge 47.

Figure 7B:
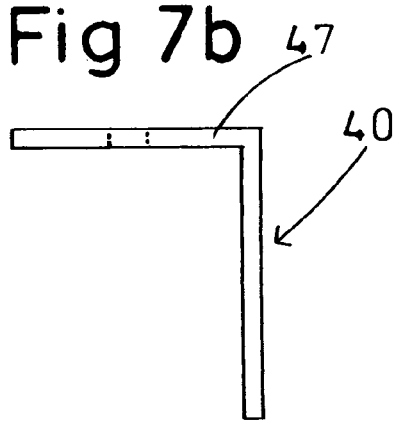
FIG. 7*b* is a top view of an L-shaped bracket used for affixing the bent rigid blade of the present invention to the back of a snowplow by utilizing the method of the present invention.

FIG. 7*b* illustrates the top edge 47 of one of said plurality of L-shaped brackets 40.

Figure 7C:
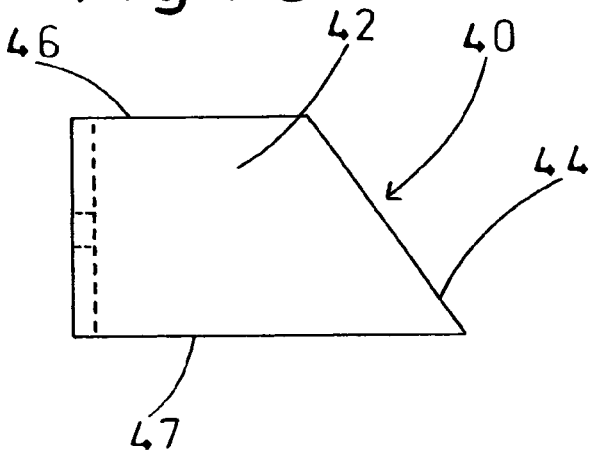
FIG. 7*c* is a side view of a second side of an L-shaped bracket used for affixing the bent rigid blade of the present invention to the back of a snowplow by utilizing the method of the present invention.

FIG. 7*c* illustrates said second side 42 of one of said plurality of L-shaped brackets 40. Said second side 42 including said top edge 46, said bottom edge 47, and said beveled back 44.

What is claimed is:

1. A backblade-and-snowplow system, wherein a bottom of a snowplow defines a front, plowing surface and an inverted shelf disposed directly behind the plowing surface and the shelf defines a first side abutting against a rear of the plowing surface and a second side of the shelf extending away from the rear of the plowing surface, said system comprising:

a bent, rigid blade defining a top and back and at least one hole in said top of said blade corresponding to a hole defined in the second side of the shelf;

at least one fastening mechanism passed through corresponding said hole defined in the second side of the shelf and said hole defined in said top of said blade to secure said blade to the shelf; and at least one L-shaped bracket defining a top edge secured along said top and back of said blade and a first side of said bracket positioned flush with the first side of the shelf and defining at least one hole of said first side of said bracket suitable for receipt of a corresponding fastening device that passes through the first side of the shelf and said hole of said first side of said bracket to secure said blade to the shelf such that a substantial entirety of said blade is disposed directly behind the plowing surface of the snowplow.

* * * * *